United States Patent [19]

Gainer

[11] 4,190,753

[45] Feb. 26, 1980

[54] HIGH-DENSITY HIGH-CONDUCTIVITY ELECTRICAL CONTACT MATERIAL FOR VACUUM INTERRUPTERS AND METHOD OF MANUFACTURE

[75] Inventor: Robert E. Gainer, Monroeville, Pa.

[73] Assignee: Westinghouse Electric Corp., Pittsburgh, Pa.

[21] Appl. No.: 895,832

[22] Filed: Apr. 13, 1978

[51] Int. Cl.[2] ..... H01H 33/66

[52] U.S. Cl. ..... 200/144 B; 75/200; 428/567

[58] Field of Search ..... 200/265, 266, 262, 144 B; 428/567; 75/200, 22

[56] References Cited

U.S. PATENT DOCUMENTS

| | | | |
|---|---|---|---|
| 2,362,007 | 11/1944 | Hensel et al. | 75/22 |
| 2,758,229 | 8/1956 | Perry | 310/231 |
| 3,818,163 | 6/1974 | Robinson | 200/144 B |
| 3,960,554 | 6/1976 | Gainer, Jr. | 75/200 |
| 4,032,301 | 6/1977 | Hassler et al. | 428/567 |

*Primary Examiner*—William D. Martin, Jr.
*Attorney, Agent, or Firm*—W. G. Sutcliff

[57] ABSTRACT

A vacuum interrupter contact is formed of copper and chromium which exhibits high electrical conductivity and a high density of greater than about 95% of the theoretical density of the materials. The copper is the predominant constituent, and a mixture of copper and chromium powder is cold-pressed to form a compact which is then vacuum-sintered at a temperature below the melting point of the copper to achieve the desired high density.

8 Claims, 3 Drawing Figures

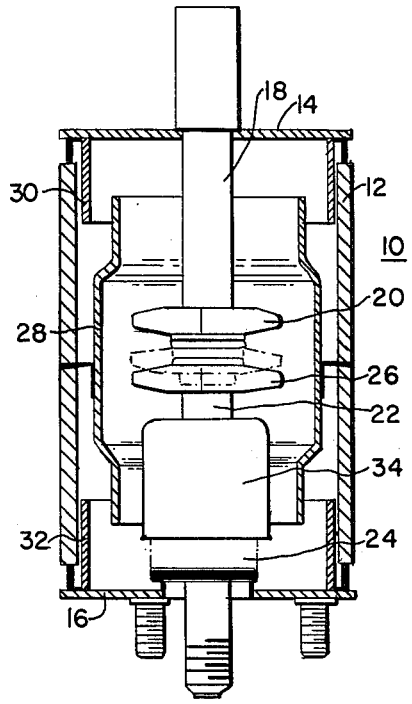
FIG. 1
FIG. 2
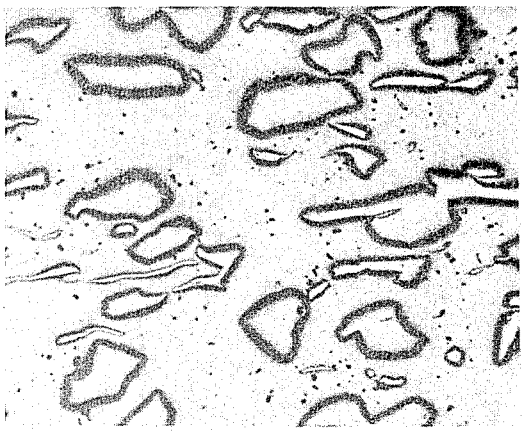
FIG. 3
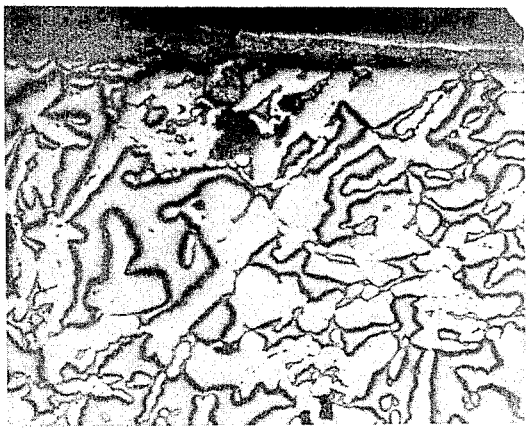

HIGH-DENSITY HIGH-CONDUCTIVITY ELECTRICAL CONTACT MATERIAL FOR VACUUM INTERRUPTERS AND METHOD OF MANUFACTURE

BACKGROUND OF THE INVENTION

The present invention relates to vacuum interrupter electrical apparatus and more particularly to the electrical contacts of such apparatus. Vacuum interrupters find application as circuit protection devices in electrical distribution systems, and comprise a sealed envelope with movable contacts disposed within the envelope for making and breaking electrical continuity. When the contacts are in a closed current carrying position in contact with each other, the contact must carry large currents efficiently with low resistance values. When the contacts are moved apart to the open circuit position an arc strikes between the contacts vaporizing some portion of the contact with a rapid quenching of the arc and interruption of the circuit. The contacts must be readily separable, i.e., have an antiweld characteristic so that the operating mechanism need not exert undue force in moving the contacts apart. While some vaporization of the contact material is necessary to sustain the arc, gross erosion of the contacts is to be avoided since this will give rise to high contact resistance when the contacts are closed for current carrying operation.

The selection of contact materials is therefore a very critical aspect in the functioning of the whole vacuum interrupter apparatus. A widely used contact material is a blend of a high-conductivity material such as copper with a higher melting point refractory metal such as chromium or tungsten. A widely used chromium matrix contact material which is infiltrated with copper is seen in U.S. Pat. No. 3,818,163. The contact is formed by sintering the chromium to form a porous hardened body which is then brought into contact with copper which is melted to infiltrate it into the pores of the chromium matrix. In another variation of this matrix contact, seen in U.S. Pat. No. 3,960,554, a small portion of copper powder is blended with the chromium powder prior to sintering of the chromium to form a matrix. This small blend of copper increases the green strength of the chromium compact during sintering which facilitates handling of the compact. The matrix contact is thereafter infiltrated with additional copper to form the completed contact.

A more recent copper-chromium contact material is described in U.S. Pat. No. 4,032,301 in which the copper and chromium are admixed as powders, and cold pressed to an intermediate density. The pressed compact is then vacuum sintered below the copper melting point to densify the contact. The contact is then hot pressed or hot-densified to achieve a final high density. The copper and chromium are present in a weight ratio of about 1 to 1. The copper content is maintained at below about 60 wt.% in order to insure successful contact operation.

It had been well known in the powder metallurgical art to compact powdered metal mixtures and press at high pressures to densify the compact to some extent, and to thereafter sinter at temperatures below melting points of the powdered metals. Such contacts are seen in U.S. Pat. No. 2,362,007 which has up to about 10% chromium, some phosphorous, with the remainder being copper. U.S. Pat. No. 2,758,229 describes a wearresistant electrical current commutator which is approximately 80% copper, 20% chromium and is formed by compacting the admixed powders at about 14 tons psi, and thereafter sintering at from 800° to 1000° C. The sintered contact is then preferably impregnated with an organic oil to further improve the wear resistance of the commutator contact.

It remains a goal to produce as high a conductivity contact for vacuum interrupter usage as is possible consistent with the need for structural rigidity, anti-weld characteristic, high-voltage withstand capability, and low outgassing from the contact during arcing.

SUMMARY OF THE INVENTION

A vacuum interrupter contact is provided which exhibits high electrical conductivity and has a high density of greater than about 95% of the theoretical density. The contact is predominantly copper which is present in an amount of about 60 to 90 wt.% with the remainder being chromium. The contact is preferably made by the process of admixing copper and chromium powders, cold isostatically pressing the admixed powders at high pressure to form a compact of high intermediate density, and thereafter vacuum sintering the compact at a temperature below the melting point of copper to achieve the desired density of greater than about 95% of theoretical.

BRIEF DESCRIPTION OF THE DRAWINGS

FIG. 1 is an elevational view partly in section of a vacuum interrupter assembly.

FIG. 2 is a hundred times magnified view of the contact material of the present invention.

FIG. 3 is a hundred times magnified view of a matrix-type contact material of the prior art.

DESCRIPTION OF THE PREFERRED EMBODIMENTS

The vacuum interrupter device 10 is shown in FIG. 1, and comprises a generally cylindrical insulating body portion 12, having sealed end members 14 and 16 at opposed ends of the body 12. A contact assembly 18 is brought through end plate 14 and has a copper-chromium contact 20 disposed at the terminal end of the conductive post of the contact assembly. The other contact assembly 22 is movably mounted through end plate 16 and includes a bellows member 24 which permits movement of the copper-chromium contact 26 disposed at the end of the assembly into closed circuit contact with contact 20. A plurality of vapor shields 28, 30 and 32 are provided within the sealed envelope about the contacts and the arcing area and a shield member 34 is provided for the bellows 24. Shield 28 is an electrically floating central shield, and shields 30 and 32 are opposed end shields which overlap the ends of the central shield to prevent deposition of arcing material upon the insulating envelope.

The copper-chromium contacts 20 and 26 can be simple disc-like members, but more typically will have a more complex shape, which may include spirally directed arms for producing a circular arc driving force to keep the formed arc in motion about the contact and minimize localized heating.

A typical contact of the present invention is fabricated as a formed disc which may have some structural detail, or can be machined to provide the spiral arms or other such surface features. The contact is typically formed by blending approximately 75% copper powder and 25% chromium powder which is thoroughly admixed. The copper powder typically about 300–400 mesh size powder, and the chromium powder is typically about 100–200 mesh size powder, which is a much larger particle size than the copper. The powder may be pretreated to minimize oxygen content. The admixed and blended copper and chromium powders are then cold isostatically pressed at approximately 50 tons psi to form an intermediate density compact. The cold isostatic pressing is carried out by placing the admixed powders into an evacuated bag which is sealed and placed in a hydraulic fluid and isostatically pressed in apparatus which is well known in the art. The compact is thereafter vacuum-sintered at below the melting point of copper as at approximately 1030° C. for about 6.5 hours to produce a compact density of greater than about 97% of the theoretical density of the materials. A hundred times enlarged showing of the cross section of the contact as prepared above is seen in FIG. 2, wherein the large spaced-apart discrete particles are the chromium particles, while the intermediate material is the copper. By way of comparison, a prior art copper infiltrated chromium matrix contact which is about 55 wt.% chromium and about 45 wt.% copper is seen in FIG. 3 in a hundred times enlarged showing. As seen in FIG. 3, the chromium powder comprises a matrix formed by sintering wherein the chromium particles abut and contact each other to form a matrix with the copper later infiltrated into the pores of the matrix by heating a copper disc placed in contact with the matrix about the melting point of copper, filling the pores between the chromium matrix particles. It had been widely thought that such a chromium matrix was required in order to provide the requisite structural strength with anti-weld characteristic, and high erosion resistance necessary for vacuum interruption operation. The contact material of the present invention in using a much higher copper content has a higher contact conductivity which makes for more efficient electrical current carrying capability during closed contact operation, and surprisingly the high copper content non-matrix contact has the requisite anti-weld characteristic, good structural rigidity necessary for reliable vacuum interrupter usage.

The percentage of copper and chromium in the contact material can be varied from about 60 to 90 wt.% copper, with the remainder being chromium in the method of the present invention to form the desired high-conductivity, high-density contacts.

In a variation of the method the blended copper and chromium powders can be initially pressed at a relatively moderate pressure of about 22 tons psi in a uniaxial press to form an intermediate density compact with a density of at least about 80 percent of theoretical. This compact is then vacuum-sintered at below the copper melting point, for example 1030° C. for a time sufficient to increase the density to at least about 90 percent of theoretical. The partially densified compact is then cold isostatically pressed at about 50 tons psi to further densify the contact to greater than 95 percent of theoretical. The contact is thereafter vacuum-sintered for a short time, at again below the copper melting point, to complete densification of the contact to greater than about 97 percent of the theoretical material density.

The vacuum sintering temperature can be varied below the melting point of copper with densification being a factor of the temperature and the time, with a practical sintering temperature range being 960°–1030° C.

I claim:

1. A vacuum interrupter contact which exhibits high electrical conductivity, and has a high density of greater than about 95% of the theoretical density, which contact is manufactured by the process consisting of admixing copper and chromium powder wherein the copper is present in an amount of greater than 65 wt.% and up to 90 wt.%, cold pressing the admixed powder to form a compact of high intermediate density, and vacuum-sintering the compact at a temperature below the melting point of the copper to achieve the density of greater than about 95%, without further hot densification.

2. The vacuum interrupter contact set forth in claim 1, wherein the admixed copper and chromium powders are initially cold pressed at about 50 tons per square inch and thereafter vacuum-sintered at a temperature of from 960°–1030° C. for a time sufficient to achieve a contact density of greater than about 97 percent of theoretical.

3. The vacuum interrupter contact set forth in claim 1, wherein the admixed copper and chromium powders are first cold uniaxially pressed at a pressure sufficient to achieve an intermediate density of at least about 80 percent of theoretical, and this intermediate density press contact is sintered at below the melting point of copper to an intermediate density of at least about 90 percent of theoretical, and the sintered contact is then cold isostatically pressed to a high density of greater than about 95 percent of theoretical and than vacuum sintered again at a temperature below the melting point of copper to achieve the contact density of greater than about 97 percent of theoretical.

4. The vacuum interrupter contact set forth in claim 1, wherein the weight ratio of copper to chromium is about 75–25.

5. A method of manufacturing high-density, copper-chromium electrical contacts for vacuum interrupters, which method consists of:

(a) admixing copper and chromium powder wherein the copper powder is present in an amount of from greater than 65 wt.% up to 90 wt.% of the total;

(b) cold pressing the admixed powders to form a high density compact;

(c) vacuum-sintering the compact at a temperature below the melting point of copper to achieve a density greater than about 97% of theoretical for the resultant contact, without further hot densification.

6. The method set forth in claim 5, wherein the admixed copper and chromium powders are initially cold isostatically pressed at about 50 tons per square inch, and thereafter vacuum-sintered at a temperature of from about 960°–1030° C. to achieve the density of greater than about 97% of theoretical for the resultant contact.

7. The method set forth in claim 5, wherein the admixed copper and chromium powders are first cold uniaxially pressed at a pressure sufficient to achieve an intermediate density of at least about 80 percent of theoretical, and this intermediate density pressed contact is vacuum-sintered at a temperature below the melting point of copper to an intermediate density of at least about 90 percent of theoretical, and this sintered contact is then cold isostatically pressed to a high density of greater than about 95 percent of theoretical and then vacuum-sintered again at a temperature below the melting point of copper to achieve a contact density of greater than about 97 percent of theoretical.

8. The method set forth in claim 7, wherein the weight ratio of copper to chromium is about 75–25.

* * * * *